United States Patent [19]

Tomatis

[11] 4,021,611

[45] May 3, 1977

[54] ELECTRONIC HEARING APPARATUS

[76] Inventor: Alfred Ange Auguste Tomatis, 68 Boulevard de Courcelles, 75008 Paris, France

[22] Filed: Apr. 23, 1976

[21] Appl. No.: 679,873

[52] U.S. Cl. ..... 179/1 N

[51] Int. Cl.[2] ..... H04R 3/00

[58] Field of Search ..... 179/1 G, 1 SP, 1 N, 179/1 NL, 107 R, 107 FD

*Primary Examiner*—George G. Stellar

[57] ABSTRACT

Electronic hearing apparatus comprising a plurality of stages in cascade each constituted by a pair of first and second operating circuits each containing an amplifier and a filter having selected response and a common control circuit for opening the first and second operating circuits to selectively and quantitatively determine the passage of signals through the two operating circuits. The first operating circuits constitute together a first channel having outputs connected in parallel to individual transducers of one or a plurality of output devices associated on one side, right or left, of the subject and all of the second circuits constitute together a second channel having their outputs connected in parallel to individual transducers of one or a plurality of output devices associated with the other side, left or right, of the subject, the various transducers transforming the received electrical signals to vibratory or sound signals.

8 Claims, 1 Drawing Figure

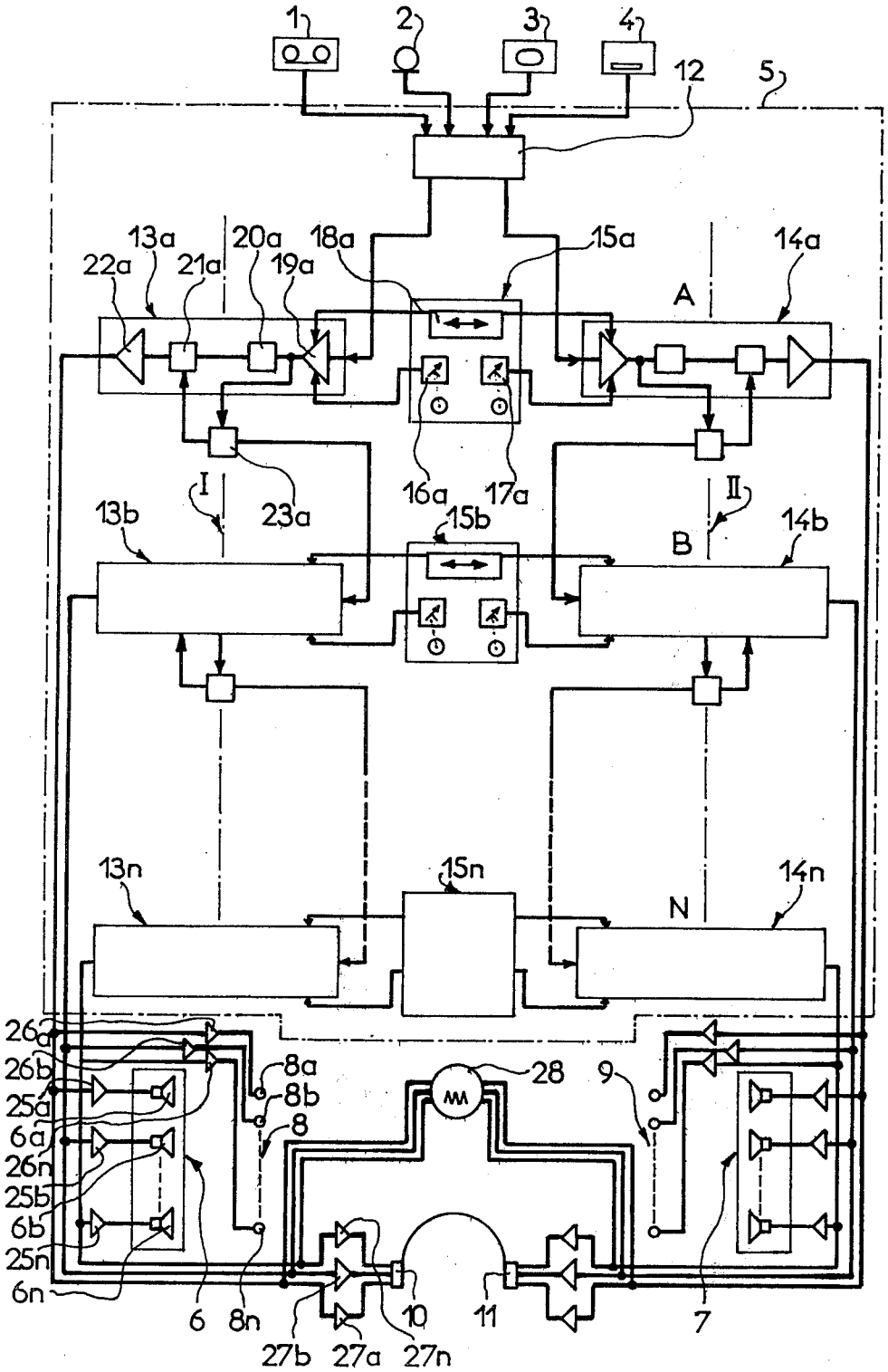
1
2
3
4
12
5
13a
20a
18a
15a
14a
22a
21a
19a
A
16a
17a
I
23a
II
13b
15b
14b
B
13n
15n
14n
N
26a
26b
25a
6a
26n
25b
6b
25n
6n
8a
8b
8
28
9
6
8n
10
11
7
27b
27a
27n

ELECTRONIC HEARING APPARATUS

FIELD OF THE INVENTION

The present invention relates to electronic hearing apparatus.

BACKGROUND

There is already known from U.S. Patent No. 3,043,913 of the applicant an apparatus specially conceived for the rehabilitation of the voice. This apparatus operates on the principle of the reaction between hearing and speaking discovered by the applicant.

Following research into the role of the internal ear on the general comportment of a human being has revealed its major role with regard to the activation of the brain considered as comprising the entire nervous system. In fact, the nervous system only functions under the condition that a permanent activation is effected. This activation is realized by the sensitive peripheral mechanism and more particularly by the internal ear which in some way serves the role of a dynamo recharging a central battery constituted by the central gray matter which in turn distributes the energy to the entire nervous system. If the permanent charge of the brain is not effected in satisfactory manner, this has the result, for the person in question, of a disturbance of the proper operation of the central mechanisms with regard to memory, concentration, activity of the human being in his integration of written and spoken language etc. This adverse operation can be translated by more or less serious difficulties such as loss of memory and concentration, depression, language difficulties leading to autism, stuttering, dyslexia, poor ability with foreign languages up to simple difficulties of the voice and also psychological and even psychiatric difficulties.

SUMMARY OF THE INVENTION

The present invention is directed to a device for obtaining optimal utilization of the internal ear and its associated mechanism and more particularly the labyrinth apparatus of the latter in its role as the apparatus for sending energizing signals to the brain.

In this regard, this electronic hearing apparatus comprises at least one input device converting sound signals to electrical signals, an apparatus for treatment of these electrical signals comprising amplifiers and filters having selected response curves for effecting a modification of the characteristics of the electrical signals received at the input and at least one output device converting the electrical signals furnished by the treatment apparatus to sound signals applied to the sensitive peripheral apparatus of a subject and notably to his ears and the apparatus is characterized in that the treatment apparatus comprises a plurality of stages in cascade each constituted by a pair of first and second treatment circuits each containing an amplifier and a filter having selected response and a common control circuit for the opening of the first and second treatment circuits to determine selectively and quantitatively the passage of the signal through these treatment circuits, and in that all the first treatment circuits together constituting a first channel have their outputs connected in parallel to individual transducers, of one or more output devices associated on one side, right or left, of the subject and in that all the second circuits constituting together a second channel have their outputs connected in parallel to individual transducers of one or more output devices associated on the other side, left or right, of the subject, the various transducers transforming the received electrical signals to vibratory or sound signals.

The therapeutic effects and advantages obtained by the apparatus according to the invention are numerous. These notably permit:

1. obtaining at the level of the ear of the subject the production of sound having optimum frequency bands for the energization of the nervous system if, of course, the subject can benefit by a considerable increase of his cortical energy;
2. regulating defective position of the muscles of the middle ear and thereby reducing a great number of acoustical deficiencies;
3. providing a therapeutic solution to problems of labyrinthic vertigo and notably vertigo from Meniere's disease;
4. modification of the neuro-vagal state by modification of the tension of the tympanic membrane and eliminating thereby vagal-sympatic difficulties of neuro-vegetative type such as asthma, allergic rhinitis, spasmodic coughing, eczema and reduction of pain;
5. treatment of disturbances of the voice and those of language.

BRIEF DESCRIPTION OF THE DRAWINGS

There will be described hereafter by way of non-limiting example one embodiment of the present invention with reference to the annexed drawing the sole FIGURE of which is a circuit diagram of an electronic hearing apparatus.

DETAILED DESCRIPTION

The apparatus comprises essentially one or a plurality of input devices for generating electrical input signals, for example, a magnetophone 1, a microphone 2, a magnetoscope 3, a phonograph disk 4, a device for operating on these input signals designated in entirety by numeral 5 and comprising all the elements contained in the interior of the rectangle shown in dotted lines in the drawing, and output devices comprising transducers and emitting from output signals produced by the operating apparatus 5 either sound signals or vibratory signals, these output devices comprising for example two assemblies of loudspeakers 6, 7, two assemblies of vibrators 8, 9 and two earphones 10, 11.

The operating apparatus 5 comprises an input preamplifier 12 to which are connected the input devices 1, 2, 3, 4, producing electrical signals corresponding to pure or complex sound. The operating or treatment apparatus 5 additionally comprises a certain number of stages A, B . . . N connected in cascade which assure individually and specifically the treatment of the signals which are applied thereto. The various constructive elements of these stages are given the same reference numerals with suffix letters *a* for stage A, *b* for stage B, etc.

Each of these stages comprises two circuits for treatment of the electrical signals respectively associated with two channels I, II corresponding to the operation with the right ear and the left ear of a subject. Thus, the treatment circuits 13*a*, 13*b*, 13*n* are associated with treatment channel I for the right ear whereas the similar treatment circuits 14*a*, 14*b*, 14*n* are associated with the second treatment channel II of the left ear. The two treatment circuits of each stage are controlled by central control circuits for the opening of the two channels I and II namely circuits 15*a*, 15*b* ... 15*n*.

As the circuits are constructed in the same manner, we will only describe in detail one of them.

The circuit 15*a* for control of the opening comprises members permitting the individual variation in each channel of the gain and the response time of amplifiers forming part of the treatment circuits 13*a*, 14*a*. For example, the circuit 15*a* for control of the opening comprises two circuits 16*a*, 17*a* permitting individual adjustment manually of the gain, that is to say, the intensity of the signals transmitted in each channel as well as the response time of the amplifiers of circuits 13*a* and 14*a*. In addition, the circuit 15*a* for opening control comprises a circuit 18*a* interconnecting the two channels and permitting automatic control of the variation of the gain or the response time of one amplifier of a channel as a function of the variation of the signals in the other channel. For example, the interaction circuit 18*a* can determine a variation of the gain in one of the channels which can be inversely proportional to the variation of the gain in the other channel or it can follow any other appropriate relation.

The treatment circuits 13*a*, 14*a* etc. are also constructed in the same fashion and there will only be described in detail one of them, namely, the circuit 13*a* of the first stage A associated with the first channel I of the right ear. This channel comprises in series an input amplifier 19*a* connected to an output of the preamplifier 12 which comprises another output connected to a corresponding amplifier of the circuit 14*a*. The gain and the response time of the amplifier 19*a* are determined either by the device for manual adjustment 16*a* or by the interaction circuit 18*a*. The output of amplifier 19*a* is connected to a filter 20*a* which can have any response curve that is desired as a function of the contemplated treatment. The filter 20*a* can be high-pass type, low-pass, band-pass or it can even have a rejection band. The output of filter 20*a* is connected through the intermediary of a gate 21*a* to an output amplifier 22*a*.

The output of amplifier 19*a* is also connected to a threshold detector circuit 23*a* which itself comprises two outputs namely, one connected to the input of control gate 21*a* and the other to the input of treatment circuit 13*b* of the second stage B.

Thus, when the level of the signal at the output of amplifier 19*a* is less than a threshold determined by circuit 23*a* as a function of its regulation, this circuit holds the gate 21*a* open and the electrical signal modified by the filter 20*a* is transmitted to the output amplifier 22*a*. In contrast, when the level of the signal at the output amplifier 19*a* exceeds the predetermined threshold established by the circuit 23*a*, the latter closes the gate 21*a* thus preventing any output of a signal from the treatment circuit 13*a* and in contrast it establishes a connection between the amplifier 19*a* and the input of the treatment circuit 13*b* of the second stage B. From this moment, the treatment circuit 13*b* of the second stage is activated and the electrical signals are amplified and filtered according to the characteristics of this circuit.

The second circuit 15*b* for control of the opening serves the same function with respect to treatment circuits 13*b* and 14*b* as the circuit 15*a* in relation to circuits 13*a* and 14*a*. The circuit for opening control 15*b* also comprises apparatus for individual adjustment of the gain and the response time of the amplifiers as well as an interaction circuit between the two channels.

The arrangement described hereinabove is found in all of the successive stages of the apparatus up to the last stage N.

The outputs of the treatment circuits 13*a*, 13*b* . . . 13*n*, associated with the first channel 1 are connected in parallel to various output devices 6, 8, 10. These output devices are notably connected respectively through the intermediary of amplifiers 25*a*, 25*b* . . . 25*n* having individually adjustable gains to loudspeakers 6*a*, 6*b* . . . 6*n* of the assembly of loudspeakers 6. These loudspeakers can have different characteristics some emitting deep sound others more acute sound etc.

The outputs of treatment circuits 13*a*, 13*b*, 13*n* are also connected in parallel through the intermediary of respective amplifiers 26*a*, 26*b* . . . 26*n* having individually adjustable gains, to vibrators 8*a*, 8*b* . . . 8*n* of an assembly of vibrators 8. These vibrators are placed on the skin of the subject at appropriate locations as a function of the desired treatment. These vibrators can also be arranged in stages from low to high values.

Finally, the outputs of the treatment circuits are also connected in parallel through the intermediary of respective amplifiers 27*a*, 27*b* . . . 27*n* having individually adjustable gains to earphone 10 associated with the right ear.

The same elements are provided for the second channel II associated with the left ear, the outputs of the treatment circuits 14*a*, 14*b* . . . 14*n* being respectively and selectively connected through the loudspeakers of assembly 7, to the vibrators of assembly 9 and to the earphone 11 through the intermediary of individual amplifiers having individually adjustable gains.

Thus, in proportion to the various stages A, B, . . . N of the treatment apparatus which are energized, the corresponding output members associated respectively with these stages are successively excited.

The assembly of the electronic hearing apparatus according to the invention permits the voluntary action on one or the other of the ears of a patient by applying to his two ears different sound signals. Due to the variable intensities that one can apply to the two channels, one can obtain necessary distribution in the auditory canals of the two ears to assure biauricular hearing, then to give rise to a dominant ear thereby progressively permitting the resumption of the appearance of predominance of the main ear.

The apparatus which has just been described offers a great flexiability in utilization due to the choice of the response curves of the filters of the circuits of the various stages, the gain of the various amplifiers, etc.

It is notably possible to utilize only a single channel for example, channel I when it is desired only to treat the right ear. It is sufficient to activate in consequence the opening control circuits 15*a*, 15*b* . . . 15*n* to close all the treatment circuits 14*a*, 14*b* . . . 14*n* appropriate to the second channel II associated with the left ear.

The installation according to the invention can also comprise at least one oscilloscope 28 or any other display device connected to the outputs of treatment circuits 13*a*, 13*b* . . . 13*n* and 14*a*, 14*b* . . . 14*n* to permit a visual control of the shape of the signals applied to the output transducers.

According to a variation, at the time of total closure of the stages with the exception of that which is activated, one can provide a passage for the signals through them with high attenuation. In this case, the gate 21*a* will be replaced by a switch operated by the threshold circuit 23*a* to direct the signals when the level thereof exceeds the predetermined threshold to an adjustable attenuater connected to the output amplifier 22*a*.

What is claimed is:

1. Electronic hearing apparatus comprising at least one input device converting sound signals to electrical signals, operating means for these electrical signals comprising amplifiers and filters having selected response curves for effecting a modification of the characteristics of the electrical signals received at the input, and at least one output means for converting the electrical signals furnished by the operating means to sound signals to be applied to the hearing mechanism of a subject, said operating means comprising a plurality of stages in cascade each constituted by a pair of first and second operating circuits each including one said amplifier and respective filter having a selected response curve, and a common control circuit for controlling the opening of said first and second operating circuits to selectively determine quantitatively the passage of the signals through the two operating circuits; all of said first operating circuits constituting together a first channel having outputs, at least one output device including a respective transducer connected in parallel to the outputs of the first channel and associated with one side, right or left of the subject, all of said second operating circuits constituting together a second channel having outputs, at least one further output device including a respective transducer connected in parallel to the outputs of said second channel and associated with the other side, left or right of the subject, said transducers transforming the received electrical signals to vibratory or sound signals.

2. Apparatus as claimed in claim 1 wherein each operating circuit of one stage comprises, in series, said amplifier as an input amplifier having adjustable gain and response time, said filter, and an electronic gate; and additionally a circuit with adjustable threshold having an input connected to the output of the amplifier, one output connected to the gate and a second output connected to the input of the operating circuit, associated with the same channel, of the following stage such that when the level of the output signal of the input amplifier is less than the threshold level fixed by said circuit, the filtered electrical signals are transmitted through the open gate and when the output signal of the amplifier exceeds the threshold level, the threshold circuit produces the closure of the gate to effect substantial interruption of the output signals of the operating circuit and transmission of these signals to the input of the operating circuit of the following stage.

3. Apparatus as claimed in claim 2 comprising control circuits for respective stages including individually adjustable means for adjustment of the gain and response time of the amplifiers of said two operating circuits associated with each stage.

4. Apparatus as claimed in claim 2 comprising control circuits for respective stages each including an interaction circuit connected to the input amplifier of the operating circuits of the associated stage for varying, according to a predetermined relation, the gain and the response time of the amplifier of one of the operating circuits as a function of the gain of the amplifier of the other operating circuit.

5. Apparatus as claimed in claim 1 wherein said transducer of said output means comprises for each channel an earphone adapted to be placed in contact with the ear of the subject, and power amplifiers connected to said earphone and connected in parallel to the outputs of said operating circuits.

6. Apparatus as claimed in claim 1 wherein said transducer of said output means comprises for each stage a loudspeaker, and power amplifiers connected to respective loudspeakers and in parallel to the outputs of said operating circuits of the same channel.

7. Apparatus as claimed in claim 1 wherein said transducer of said output means comprises for each stage a vibrator adapted for being placed into contact with the skin of the subject, and power amplifiers connected to respective vibrators and in parallel to the outputs of said operating circuits of the same channel.

8. Apparatus as claimed in claim 1 comprising at least one oscilloscope connected to the outputs of the operating circuits of said stages.

* * * * *